United States Patent [19]

Secter

[11] 4,411,026

[45] Oct. 25, 1983

[54] HAND COVERING

[76] Inventor: Michael Secter, c/o Robert Engel, P.O. Box 2421, Santa Fe, N. Mex. 87501

[21] Appl. No.: 277,056

[22] Filed: Jun. 24, 1981

[51] Int. Cl.[3] ..... A41D 00/00; A41D 19/02 A41D/19/00

[52] U.S. Cl. ..... 2/158; 2/159; 2/169

[58] Field of Search ..... 2/158, 159, 169, 164; 46/154

[56] References Cited

U.S. PATENT DOCUMENTS

| | | | |
|---|---|---|---|
| 1,037,946 | 9/1912 | Mahieu | 2/169 |
| 1,714,648 | 5/1929 | Walker | 2/164 X |
| 2,226,604 | 12/1940 | Geissmann | 2/169 |
| 2,256,427 | 9/1941 | Gitt | 2/169 X |
| 2,284,541 | 5/1942 | Sperandeo | 2/169 |
| 3,267,486 | 8/1966 | Madnick | 2/164 |

FOREIGN PATENT DOCUMENTS

| | | | |
|---|---|---|---|
| 532047 | 1/1941 | United Kingdom | 2/169 |

*Primary Examiner*—Richard J. Scanlan, Jr.
*Attorney, Agent, or Firm*—Posnack, Roberts, Cohen & Spiecens

[57] ABSTRACT

A hand covering comprising a blank of material including front and back portions secured together along perimetral edges to form an enclosure having an access opening. The front and back portions include respective radially projecting portions extending laterally so that when the radially projecting portions are secured together, a hollow thumb covering is formed which is flexed to project from the front and back portions when a hand of a user is inserted into the closure. The hand covering can be in the form of a mitt, glove or puppet.

8 Claims, 8 Drawing Figures

HAND COVERING

FIELD OF THE INVENTION

The invention relates to a hand covering such as a glove or mitt and, also, to hand puppets.

PRIOR ART STATEMENT

Various designs for hand coverings are known in the art which are made by folding a piece of material and securing the same along its edges. Generally, the art provides for the formation of a mitt consisting of a thumb portion and a main portion which houses the other fingers of the user.

Topping, U.S. Pat. No. 83,800 shows a mitten which is formed from a piece of material consisting of front and back portions with separate parts for the thumb. In forming the mitten, one of the thumb parts is folded into a position to adjoin the other thumb part when the material is folded so that sewing can then take place to complete the formation of the mitten.

Hollenback, U.S. Pat. No. 1,417,323 shows a similar arrangement in which one of the thumb parts is preliminarily folded so that when the front and back portions of the mitten are placed into overlying relation, the thumb parts will be in position to be sewn together to form the thumb covering of the mitten.

Madnick, U.S. Pat. No. 3,377,627 shows a method of making a hand covering having a curved palm. This covering relies on the use of two separate pieces to form the covering.

Hagstrom, U.S. Pat. No. 2,632,172 discloses a hand covering which requires several parts in the assembly thereof.

SUMMARY OF THE INVENTION

An ojbect of the invention is to provide a hand covering which conforms to the natural form and movement of the body and, particularly, where the thumb covering is constructed and arranged to receive the thumb of the user in a natural position.

It is a further feature of the invention to provide a hand covering as above in which the body of the glove curves slightly forwardly into the natural form of the hand in repose.

It is another object of the invention to provide a hand covering of the above type in which the covering for the thumb will be flexed to assume a position to project from the body of the glove and thereby accommodate itself to the natural position of the thumb of a user's hand.

Yet another object of the invention is to provide a hand covering, particularly adapted as a mitt and, specifically, useful as an oven mitt.

Still another object of the invention is to provide a hand covering which can serve as a hand puppet and in which the limbs of the puppet can accommodate fingers of the user wherein the limbs project naturally forwardly which makes manipulation more natural for the hand of the user and, especially, the wrist.

Yet another object of the invention is to permit the hand puppet to be filled to produce a stuffed toy. According to a feature of the invention, the filling can be selectively inserted and removed to permit the puppet to be convertible to the stuffed toy and vice versa.

In accordance with the above and further objects of the invention, there is provided a hand covering which comprises a blank of material including front and back portions having respective bases and perimetral edges extending from the bases. The front and back portions are folded into overlying positions along a common juncture and secured together along the perimetral edges to form an enclosure in which the bases form an open edge for the insertion of the hand of the user. The front and back portions include respective radially projecting portions extending laterally from each of the front and back portions and they are out of alignment so that when secured together along the perimetral edges thereof, a hollow thumb covering is formed which lies at an angle across the enclosure and is flexed to project from the plane of the front and back portions when a hand of the user is inserted into the enclosure.

When the blank of material is laid flat, the projecting portions extend in diametric opposition to one another.

In a particular embodiment, the projecting portion from the front portion extends in a direction in a slight downwards angle towards the base of the front portion and the projecting portion from the back portion extends in a direction at a slight upwards angle away from the base of the back portion.

In an embodiment in which the hand covering can serve as a hand puppet, the front and back portions are secured along the bases and the back portion is provided with an access opening for the hand of the user. In this arrangement, four pairs of projections can be provided to form four appendages serving as limbs for the puppet.

When the hand covering is to be used as a glove, the front and back portions respectively include finger portions which are secured together when the front and back portions are folded into overlying relation to form finger coverings.

The invention will be described in greater detail hereafter with reference to the attached drawings.

DETAILED DESCRIPTION

Figure 1:
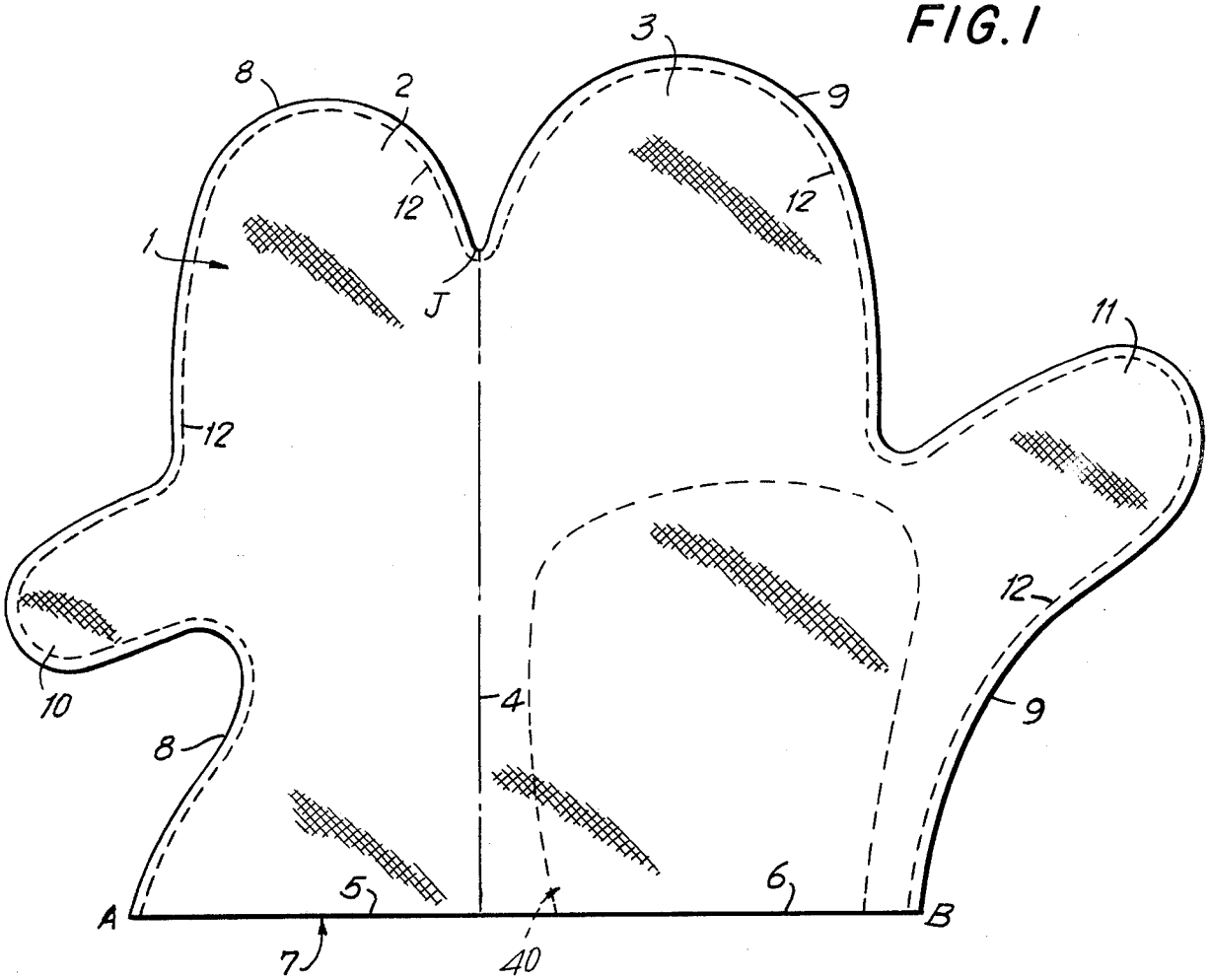
FIG. 1 is a plan view of an open blank of material which can form a mitt according to the invention.

Referring to the drawing, FIG. 1 shows a blank of material 1 which comprises a front portion 2 and a back portion 3 joined along a juncture line 4. The front and back portions have respective bases 5,6 which cooperatively form a lower edge or base 7 of the blank.

The front of the blank is of smaller size than the back so that when the hand covering is ultimately formed, it will assume a slightly curved forwardly configuration corresponding to the natural form of the hand in repose.

The front portion has a bounding edge 8 which extends from a point A at the end of base 5 to the juncture J with the back portion. The back portion has an edge 9 which extends from the point B at the end of base 6 to the juncture J with the front portion.

The front portion 2 has a radially projecting loop portion 10 which extends laterally from the front portion in a slightly inclined disposition towards the base 7. The back portion 3 has a radially projecting loop portion 11 extending laterally therefrom in a slightly upwardly inclined disposition away from the base 6. The edge 8 of the front portion 2 extends along a segment at a relatively steep angle from point A at the base 7 and then curves around to join the loop portion 10. The edge 9 of the back portion 3 extends along a segment from point B on base 7 at a steep angle to join with the loop portion 11. Edges 8 and 9 are inclined in the same direction from points A and B respectively.

In order to form the hand covering, the blank of material is folded along juncture 4 and stitching is commenced from the base 7 proximate the location where points A and B overlap one another. The stitching extends all along the perimetral edge of the overlapped portions as shown in dotted lines at 12. After the stitching has been completed, the article is folded inside-out to furnish the completed mitt.

Figure 5:
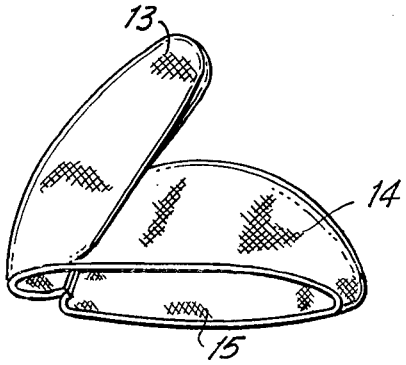
FIG. 5 is a bottom elevation view of the mitt in FIG. 3.
Figure 3:
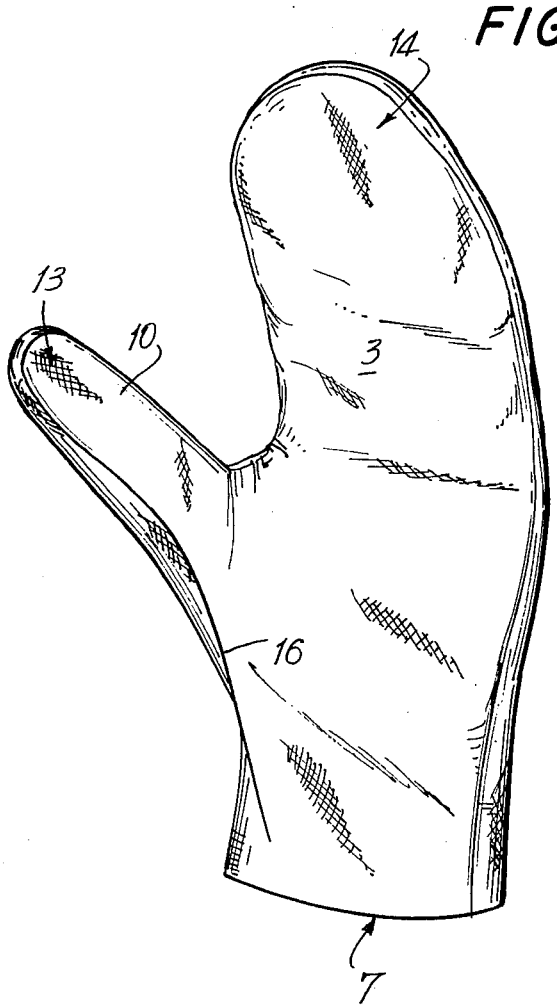
FIG. 3 is a perspective view from the right side of the mitt in FIG. 2 where the thumb is shown in its outwardly flexed position.
Figure 4:
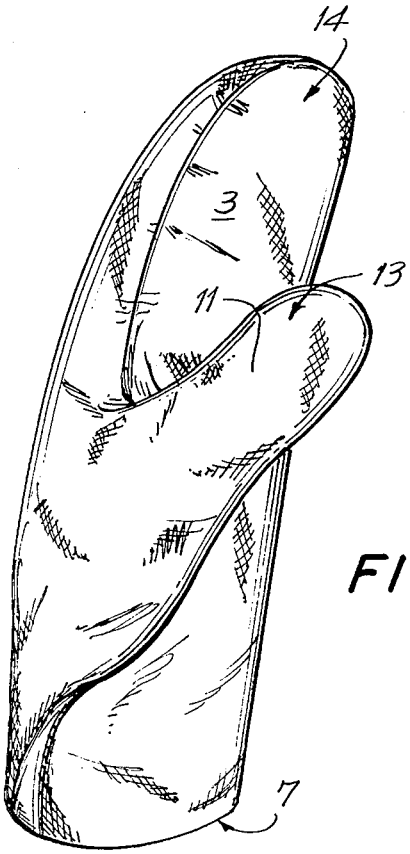
FIG. 4 is a perspective view from the left side of FIG. 3.

Because the projecting portions 10 and 11 extend radially from the front and back portions respectively and, also, because they extend substantially in diametric opposition in the blank as shown in FIG. 1, when they are secured together by stitches 12, the resulting thumb covering will be stressed or flexed to project from the plane of the front and back portions when a hand of a user is inserted into the enclosure. This is shown in FIGS. 3–5 where the projecting position of the thumb covering 13 is shown in relation to the remaining main hand portion 14.

It is noted that stitching is not effected along edge 7 so that an opening 15 can be formed at the bottom of the mitt for insertion and removal of the hand of the user.

Figure 2:
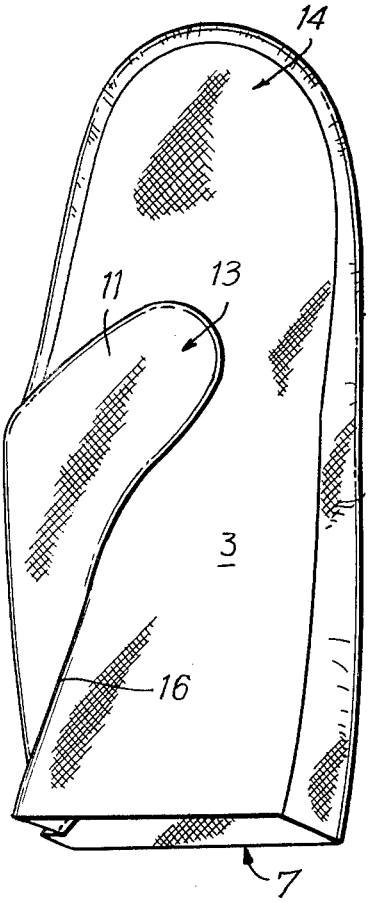
FIG. 2 is a plan view of the mitt after assembly thereof from the blank in FIG. 1, the thumb covering being folded flat.

The inclined disposition of edges 8 and 9 will result in the formation of a seam 16 (FIG. 2) which is inclined with respect to the base 7 and which contributes to the flexing action for lifting the thumb covering from the body portion 14.

Because of the larger area of the back portion 3 as compared to the front portion 2, when these portions are joined together at stitches 12, the body portion 14 is slightly curved forwardly into the natural shape of the hand in repose.

The blank of material 1 can be uniform in its composition in which case the mitt will have uniform properties throughout. However, for an oven mitt, the front portion can be formed of heat-resistant material or can have a greater thickness than the back portion.

Figure 6:
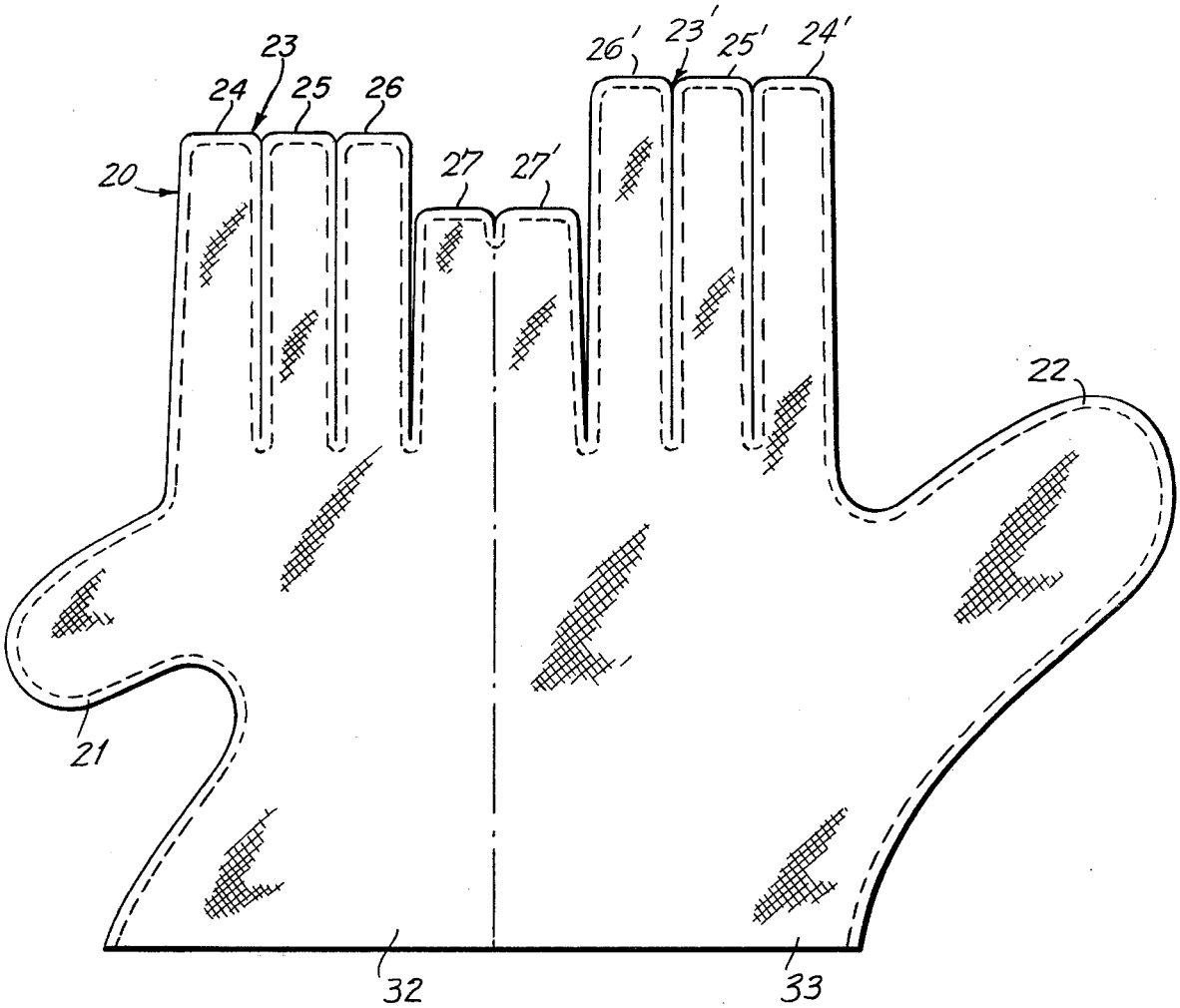
FIG. 6 is a plan view of an open blank similar to FIG. 1 but for a glove.

FIG. 6 is similar to FIG. 1 except that it is applicable to the formation of a glove as distinguished from a mitt. In FIG. 6, the blank of material is shown at 20 and the projecting portions for the thumb are shown at 21 and 22 and occupy the same relationship to be blank of material as the projecting portions in the embodiment in FIG. 1. In FIG. 6, however, these are individual finger elements 23 consisting of forefinger portion 24, middle finger portion 25, ring finger portion 26 and pinky portion 27, all on the front portion 32. Corresponding finger elements 23' are shown on the back portion 33 consisting of finger portions 24' and 27'.

An insert piece can be introduced into the finger portions and palm portions so that when the front and back portions are stitched together, the insert piece will form a double layer.

Figure 7:
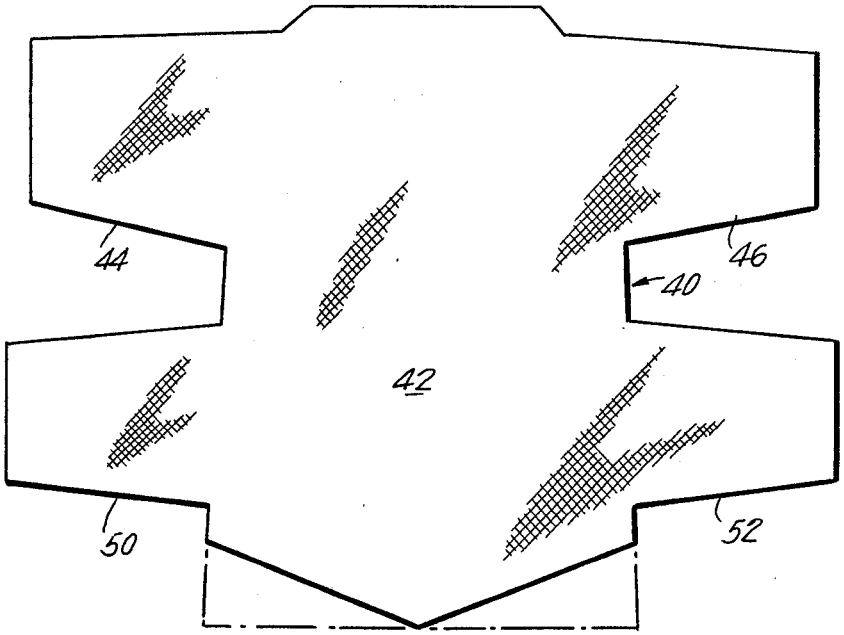
FIG. 7 is a plan view of a blank for the front portion of a hand puppet.
Figure 8:
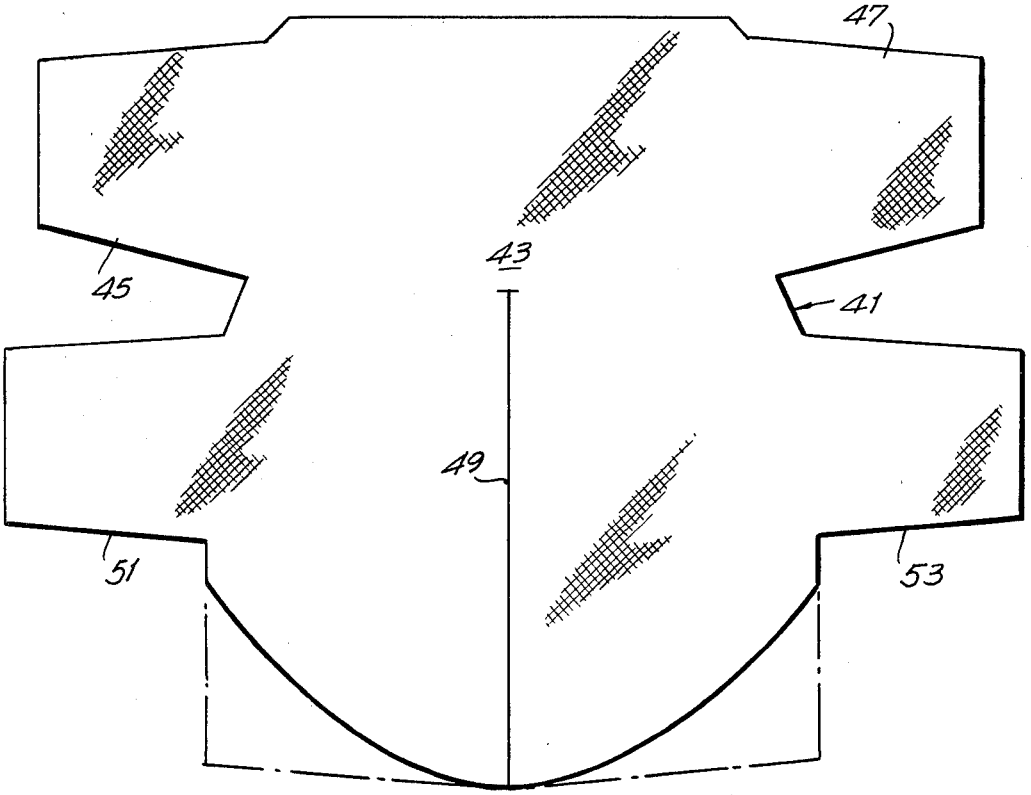
FIG. 8 is a plan view of a blank for the rear portion of a hand puppet.

The hand covering is also suitable for use as a hand puppet as shown in FIGS. 7 and 8. In FIG. 7 is seen the front portion 40 for the hand puppet and FIG. 8 shows the back portion 41. The front portion 40 includes a main body portion 42 and individual projecting portions 44 and 46. The back portion 41 includes a main body portion 43 and individual projecting portions 45 and 47. In order to assemble the hand puppet, the front and back portions are placed on one another and are stitched along the perimetral edges of the front and back portions. As access opening 49 is provided in the back portion to permit access to the interior of the assembled body of the puppet. The projecting portions 44–47 which are secured together form appendages for the puppet and, in particular, the arms of the puppet. The main body portion and the projecting portions of the back part are larger than those of the front part to provide a natural curve of the puppet in a forwardly direction with the arm appendages of the puppet projecting forwardly. This will enable the user to fit the puppet on his hand comfortably in a position of natural repose of the fingers and the hand to allow the puppet to be easily manipulated. Projecting portions 50–53 are formed on the front and back portions to form appendages for the legs of the puppet and are optional. The lower edges of the front and back portions are preferably inclined as respectively shown by the straight edges for front portion 40 in FIG. 7 and the curved edges for back portion 41. However, the lower edges may be flatter as shown by the chain-dotted lines in FIGS. 7 and 8.

The access opening 49 not only provides access for the hand of user, but it also allows the puppet to be stuffed with a form-fitting mold which can be easily introduced and replaced as desired to convert the puppet from a hand puppet to a stuffed toy and vice versa. Of course, other stuffing material can be employed within the skill of the artisan to form a stuffed toy. An openable closure can be formed at the access opening 49 such as by the provision of a zipper or Velcro attachement. This allows the puppet also to serve as a carry-bag, thereby, further enlarging its use.

If it is found necessary to confer a more forward flexing of the appendages of the puppet, the projecting portions 44,46 of the front portion 40 can be inclined downwardly and the projecting portions 45,47 on the back portion can be inclined upwardly so that the overlapped projecting portions occupy the same relation as in the mitt in FIG. 1.

Although the invention has been described in relation to specific embodiments thereof, numerous modifications and variations can be made within the spirit and scope of the invention as defined in the attached claims.

Thus, by way of example, although it has been stated previously that after stitching has been completed, the article is folded inside-out to finish the completed mitt, it is also possible to leave the mitt as is so that it can be used by left and right handed persons.

In another arrangement, a portion of the back is cut-out as shown in dotted lines in FIG. 1 at 40 which enables the user's hand to be slipped in and out easily while still protecting the fingers, hand and thumb completely.

In the embodiment of FIG. 6 where a glove has been shown, it is possible to achieve a similar effect by forming the front and back portions as continuous pieces without the individual finger elements 24–27 and 24'–27', i.e. similar to portions 2 and 3 of the mitt in FIG. 1. In order to form four finger portions in such a mitt, three individual pieces are used as separators between the four fingers and a fourth piece is used as a side piece for the forefinger, said side piece facing the thumb portion. The four pieces are stitched to the front and back portions.

In order to simplify costs, in another modification the front and back portions can be made equal in size.

What is claimed is:

1. A hand covering comprising a blank of material including front and back portions having respective bases and perimetral edges extending from said bases, said front and back portions being folded into overlying relation along a fold line serving as a common juncture and secured together along said perimetral edges to form an enclosure in which said bases form an open edge and the front and back portions lie in a plane, said front and back portions prior to folding thereof including respective radially projecting portions extending laterally from each of said front and back portions, said projecting portion from said front portion extending in a direction inclined to said fold line at a slight downwards angle towards said base of said front portion while said projecting portion from said back portion extends in a direction inclined to said fold line at a slight upwards angle away from said base of said back portion, said projecting portion from said rear portion being of larger size than said projecting portion from said front portion, said projecting portions being respectively of smaller size than their respective front and rear portions, said perimetral edges of said front and back portions including line segments joining said bases with said projecting portions smoothly and without discontinuity, said line segments being inclined in the same direction at acute angles with respect to said bases, such that when said portions are folded and secured together along the perimetral edges thereof and thereafter folded inside-out hollow thumb covering is formed which lies at an angle across said enclosure and is flexed to project from the plane of the front and back portions when a hand of a user is inserted into said enclosure.

2. A hand covering as claimed in claim 1 wherein said back portion has a greater area than said front portion.

3. A hand covering as claimed in claim 2 wherein said blank of material is formed from one piece of material.

4. A hand covering as claimed in claim 1 wherein said front and back portions include finger portions which are secured together when said front and back portions are folded into overlying relation to form finger coverings.

5. A hand covering as claimed in claim 4 comprising an insert piece secured between said front and back portions.

6. A hand covering as claimed in claim 1 wherein said front and back portions are formed from two different compositions.

7. A hand covering as claimed in claim 1 wherein said front portion has a greater thickness than said back portion.

8. A hand covering as claimed in claim 1 wherein said line segments are curved.

* * * * *